US009676534B2

(12) United States Patent
Psalidas et al.

(10) Patent No.: US 9,676,534 B2
(45) **Date of Patent: *Jun. 13, 2017**

(54) CARTON AND CARTON BLANK

(71) Applicant: MeadWestvaco Packaging Systems, LLC, Richmond, VA (US)

(72) Inventors: Maria Psalidas, Sydney (AU); Caleb S. Loftin, Richmond, CA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/664,163

(22) Filed: Mar. 20, 2015

(65) Prior Publication Data

US 2015/0191285 A1 Jul. 9, 2015

Related U.S. Application Data

(63) Continuation of application No. 13/984,839, filed as application No. PCT/US2012/024768 on Feb. 10, 2012, now Pat. No. 9,010,533.

(60) Provisional application No. 61/442,144, filed on Feb. 11, 2011.

(51) Int. Cl.

| | |
|---|---|
| ***B65D 71/22*** | (2006.01) |
| ***B65D 71/32*** | (2006.01) |
| ***B65D 5/42*** | (2006.01) |

(52) U.S. Cl.

CPC ..... *B65D 71/22* (2013.01); *B65D 5/4204* (2013.01); *B65D 71/32* (2013.01); *B65D 2571/0066* (2013.01); *B65D 2571/00185* (2013.01); *B65D 2571/00271* (2013.01); *B65D 2571/00277* (2013.01); *B65D 2571/00283* (2013.01); *B65D 2571/00308* (2013.01); *B65D 2571/00444* (2013.01); *B65D 2571/00845* (2013.01)

(58) Field of Classification Search

CPC ..... B65D 71/22; B65D 71/32; B65D 71/20; B65D 5/4204; B65D 2571/00283

USPC ..... 206/434, 427, 429, 783, 779, 782, 775; 229/117.15, 162.1, 103.2, 162.3, 162.6

See application file for complete search history.

(56) References Cited

U.S. PATENT DOCUMENTS

| | | | | |
|---|---|---|---|---|
| 1,968,877 | A | 8/1934 | Cubberley | |
| 2,182,065 | A | 12/1939 | Warren | |
| 2,522,950 | A | 9/1950 | Keith | |
| 2,571,833 | A | 10/1951 | Chidsey | |
| 2,690,839 | A | 10/1954 | Robinson | |
| 2,881,914 | A * | 4/1959 | Woeber | B65D 71/22 206/197 |
| 3,270,868 | A | 9/1966 | Pantalone | |

(Continued)

FOREIGN PATENT DOCUMENTS

| | | |
|---|---|---|
| EP | 1232957 | 8/2002 |
| FR | 2525184 | 10/1983 |
| WO | WO200901969 | 7/2009 |

*Primary Examiner* — Steven A. Reynolds

(74) *Attorney, Agent, or Firm* — WestRock Intellectual Property Group

(57) ABSTRACT

A carton for packaging one or more articles, includes a series of main panels hinged one to the next to form a tubular structure. The tubular structure includes a top panel, first and second side panels and a bottom panel and at least one display window struck from at least one of the side panels. The at least one window extends from the top panel to the base panel and is interrupted by a retention strap.

19 Claims, 7 Drawing Sheets

(56) References Cited

U.S. PATENT DOCUMENTS

| | | | | | |
|---|---|---|---|---|---|
| 3,424,299 | A | * | 1/1969 | Rosenburg, Jr | B65D 5/5002 206/763 |
| 4,117,924 | A | | 10/1978 | Growney | |
| 4,126,220 | A | | 11/1978 | Roccaforte | |
| 4,230,729 | A | * | 10/1980 | Hoelzel, Jr. | B65D 5/5007 206/777 |
| 4,533,047 | A | | 8/1985 | Calvert | |
| 4,629,068 | A | * | 12/1986 | Pugh | B65D 5/5002 206/426 |
| 4,736,846 | A | | 4/1988 | Durand | |
| 5,156,276 | A | | 10/1992 | Lebowitz | |
| 5,437,363 | A | * | 8/1995 | Gungner | B65D 71/16 206/140 |
| 5,595,299 | A | | 1/1997 | LeBras | |
| 5,816,411 | A | | 10/1998 | Smith | |
| 6,016,906 | A | | 1/2000 | Kruse et al. | |
| D432,413 | S | | 10/2000 | Owens | |
| 6,527,108 | B1 | | 3/2003 | Blin | |
| 7,322,464 | B2 | | 1/2008 | Blin | |
| D570,210 | S | | 6/2008 | McGrath | |
| 8,424,677 | B2 | | 4/2013 | Spivey | |
| 9,010,533 | B2 | * | 4/2015 | Psalidas | B65D 71/22 206/427 |
| 2009/0242444 | A1 | | 10/2009 | LeBras | |

* cited by examiner

CARTON AND CARTON BLANK

CROSS-REFERENCE TO RELATED APPLICATIONS

This application is a continuation of U.S. application Ser. No. 13/984,839, filed Nov. 15, 2013, now U.S. Pat. No. 9,010,533, issued Apr. 21, 2015, which is a National Phase of POT Application No. PCT/US2012/024768, filed Feb. 10, 2012, which claims the benefit of U.S. Provisional Application No. 61/442,144, filed Feb. 11, 2011, which are incorporated herein by reference in their entireties.

FIELD OF INVENTION

The invention relates to cartons for packaging articles and blanks for forming the same. In particular, though not exclusively, the present invention relates to cartons comprising a window panel through which the carton contents are accessible though not removable, which window panel engages a lower portion of the article, and a blank for forming the same.

BACKGROUND OF THE INVENTION

In the field of packaging it is desirable to provide a package, comprising one or more articles, one or more of which articles is visible from the exterior of the package. This promotes awareness of the contents of the package and reduces the need for additional promotional advertising on the packaging itself. However, it is desirable that the article(s) contained in the packaging be securely retained therein until it is desired that it or they be removed. To this end it is advantageous that the article(s) that are visible from the exterior of the package also be securely retained within the package.

It is the aim of the present invention to provide a carton for packaging one or more articles that allow an article to be visible exterior of the carton yet retained within the carton until it is desired that an article be removed.

It may also be desirable to obscure a portion of the article for example to hide a product code, a label or other branding or information on the article.

SUMMARY OF INVENTION

The present invention seeks to overcome or at least mitigate the problems of the prior art.

A first aspect of the present invention provides a carton for packaging one or more articles which carton comprises a series of main panels hinged one to the next forming a tubular structure comprising a top panel, first and second side panels and a base panel, the tubular structure comprising at least one display window struck from at least one of the side panels and extending from the top panel to the base panel which display window is interrupted by a retention strap.

This has the advantage of improving retention of the article within the carton.

Another advantage is that the orientation of the article need not be controlled during packaging.

Preferably, the display window comprises one or more window panels hinged to the side wall from which the display window is struck.

Preferably, the retention strap engages with a flange or protrusion of the article being displayed in the display window.

Preferably, the retention strap obscures from view a portion of the article being displayed.

Preferably, the portion of the article obscured by the retention strap is less in surface area than the portion displayed in the window.

Preferably, the article being displayed comprises a first linear dimension such as height and the retention strap obscures less of said first linear dimension than the window exposes or displays.

A second aspect of the present invention provides a blank for forming a carton of the wraparound type, the blank comprising: a first bottom panel, a first side panel, a top panel, a second side panel and a second bottom panel hinged one to the next in series, at least the first side panel comprising means for forming a display window comprising at least two hingable tabs separated by a weakened line of severance, weakened line and hingable tabs extending from one of the bottom panels locking and terminating at a retention strap integrally formed within the first side panel and being contiguously formed therewith to retain an article contained by a carton formed from the blank and displayed in the display window which is formed when the hingable tabs are folded inwardly of the carton.

Preferably, the hingable tabs are each defined by a curved weakened line.

Preferably, the curved weakened line is formed from an alternating series of half-depth cuts and creases.

Preferably, the retention strap is defined by two spaced cut lines, wherein the curved weakened lines of the hingable tabs each terminate on one of the two spaced cut lines and wherein the other of said two-spaced cut lines defines, at least in part, an article receiving aperture.

Preferably, the two spaced cut lines are both substantially arcuate in shape.

Preferably, the means for forming a display window comprises four hingable tabs, the four hingable tabs being separated longitudinally by the weakened line and laterally by the retention strap, wherein the retention strap is defined by two spaced cut-lines.

Preferably, the two-spaced cut-lines are similarly shaped, are not similarly shaped, are linear-shaped are curved or are curvilinear shaped.

A third aspect of the present invention provides a carton of the wraparound type comprising: a first bottom panel, a first side panel, a top panel, a second side panel and a second bottom panel hinged one to the next in series, the first and second bottom panels being connected together to form a tubular structure, at least the first side panel comprising a display window comprising at least two inwardly hinged tabs separated by a weakened line of severance, the weakened line and hingable tabs extending from one of the bottom panels and terminating at a retention strap integrally formed within the first side panel and being contiguously formed therewith to retain an article contained by the carton and displayed in the display window.

Preferably, the hingable tabs are each defined by a curved weakened line.

Preferably, the curved weakened line is formed from an alternating series of half-depth cuts and creases.

Preferably, the retention strap is defined by two spaced cut lines, wherein the curved weakened lines of the hingable tabs each terminate on the lowermost of the two spaced cut lines and wherein the other of said two-spaced cut lines defines, at least in part, an article receiving aperture.

Preferably, the two spaced cut lines are both substantially semi-circular shaped.

Preferably, the display window comprises four hingable tabs, the four hingable tabs being separated longitudinally by the cut line and laterally by the retention strap and wherein the retention strap is defined by two spaced cut lines.

Preferably, the two-spaced cut lines are similarly shaped, are not similarly shaped, are linear shaped, are curved or are curvilinear shaped.

A fourth aspect of the present invention provides a blank for forming a carton, the blank comprising a series of main panels for forming carton structure including a side panel, the side panel comprising means for forming a display window having at least two hingable tabs separated by a cut line the cut line and hingable tabs extending from a lower part of the side panel and being interrupted by a retention strap integrally formed within the side panel and being contiguously formed therewith for retaining an article contained by a carton formed from the blank and displayed in the display window which window is formed when the hingable tabs are folded inwardly of the carton.

Preferably, for forming a carton of the wraparound type, the blank comprising: a first bottom panel, a first side panel, a top panel, a second side panel and a second bottom panel hinged one to the next in series, the first and second bottom panels each comprising a co-operative part of a complementary locking mechanism, at least the first side panel comprising the means for forming a display window and wherein, the cut line and the hingable tabs extend from one of the co-operative parts of the complementary locking mechanism formed in the first bottom panel and terminate at the retention strap.

Preferably, the hingable tabs are each defined by a curved weakened line.

Preferably, the curved weakened line is formed from an alternating series of half-depth cuts and creases.

Preferably, the retention strap is defined by two spaced cut lines, wherein the curved weakened lines of the hingable tabs each terminate on one of the two spaced cut lines and wherein the other of said two-spaced cut lines defines, at least in part, an article receiving aperture.

Preferably, the two spaced cut lines are both substantially semi-circular shaped.

Preferably, the means for forming a display window comprises four hingable tabs being separated longitudinally by the cut line and laterally by the retention strap and wherein the retention strap is defined by two spaced cut lines.

Preferably, the two spaced cut lines are similarly shaped, are not similarly shaped, are linear shaped are curved or are curvilinear shaped.

A fifth aspect of the present invention provides a carton comprising a side panel having a display window, the display window comprising at least two inwardly hinged tabs separated by a cut line, the cut line and hingable tabs extending from a lower part of the side panel an being interrupted by a retention strap integrally formed within the side panel and being contiguously formed therewith for retaining an article contained by the carton and displayed in the display window.

Preferably, the carton is of the wraparound type and comprises: a first bottom panel, a first side panel, a top panel, a second side panel and a second bottom panel hinged one to the next in series, the first and second bottom panels each comprise a co-operative part of a complementary locking mechanism and are thereby connected together to form a tubular structure, at least the first side panel comprising the display window and the cut line and the hingable tabs extend from one of the co-operative parts of the complementary locking mechanism formed in the first bottom panel and terminate at the retention strap.

Preferably, the hingable tabs are each defined by a curved weakened line.

Preferably, the curved weakened line is formed from an alternating series of half-depth cuts and creases.

Preferably, the retention strap is defined by two spaced cut lines, wherein the curved weakened lines of the hingable tabs each terminate on the lowermost of the two spaced cut lines and wherein the other of said two-spaced cut lines defines, at least in part, an article receiving aperture.

Preferably, the two spaced cut lines are both substantially semi circular shaped.

Preferably, the display window comprises four hingable tabs, the four hingable tabs being separated longitudinally by the cut line and laterally by the retention strap and wherein the retention strap is defined by two spaced cut lines.

Preferably, the two spaced cut lines are similarly shaped, are not similarly shaped, are linear shaped, are curved or are curvilinear shaped.

A sixth aspect of the present invention provides a carton for packaging one or more articles which carton comprises a series of main panels hinged one to the next forming a tubular structure, the tubular structure comprising a top panel, bottom panel and a pair of opposing side panels, at least one of the side panels comprising a display window, the display window comprising a first aperture extending from the top panel to a first upper edge of a retention strap and a second aperture extending from the bottom panel to a second lower edge of said retention strap.

Preferably, the second aperture comprise a first pair of window panels hinged to opposing sides thereof and foldable inwardly of the carton Preferably, the first aperture comprises a second pair of window panels hinged to opposing sides thereof and foldable inwardly of the carton.

Preferably, the or each window panel of the second aperture comprises a weakened line of severance disposed between a hinged connection to the side wall and a free distal edge and extending from a lowermost edge of the window panel towards which weakened defines in part a yieldable tab for accommodating article.

Preferably, the retention strap comprises an engaging edge for engaging with a flange or protrusion of an article.

Preferably, the retention strap obscures information displayed on an article displayed within the display window.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. Indeed it will be understood that the packages, blanks and cartons described herein may be embodied in various and alternative forms. The Figures are not necessarily to scale and some features may be exaggerated or minimized to show details of particular components. Well-know components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

The present invention relates generally to a carton for packaging articles which carton comprises an article engaging arrangement for engaging an article. The preferred embodiments described herein further comprise a viewing window arrangement or display window 59 struck from a wall of the carton, which window presents for view a substantial portion of an article contained within the carton, adjacent to that side wall. The present invention is particularly suited to engaging articles formed with a petaloid lower portions (that is to say, lower portions that take the form or shape of a petal of a flower) such as is common amongst drinks bottles, the aforementioned recess being formed, in which case, between adjacent 'petals' thereof, however use of the carton with other types of article is envisaged.

Figure 1:
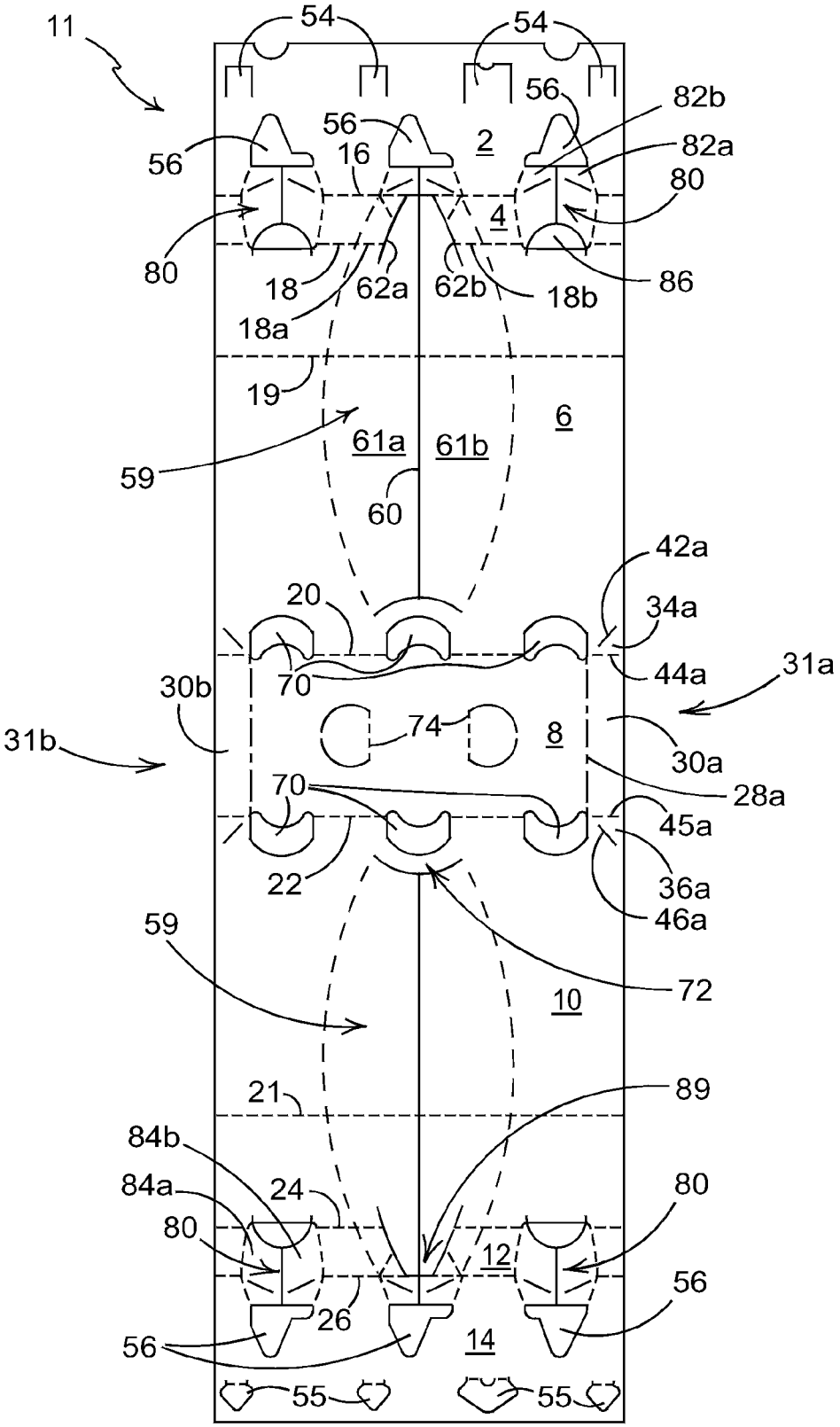
FIG. 1 is a plan view of a blank for forming a carton according to a first preferred embodiment of the present invention.

Turning to FIG. 1, there is illustrated a blank 11 for forming a carton according to a first embodiment. The blank 11 comprises a linear series of panels consisting of a first bottom panel 2, a first bevel panel 4, a first side panel 6, a top panel 8, a second side panel 10, a second bevel panel 12 and a second bottom panel 14 hinged one to the next by corresponding fold lines 16, 18, 20, 22, 24, 26.

First side panel 6 comprises a fold line 19 extending longitudinally across the first side panel 6. Second side panel 10 comprises a fold line 21 extending longitudinally across the second side panel 10.

Figure 5:
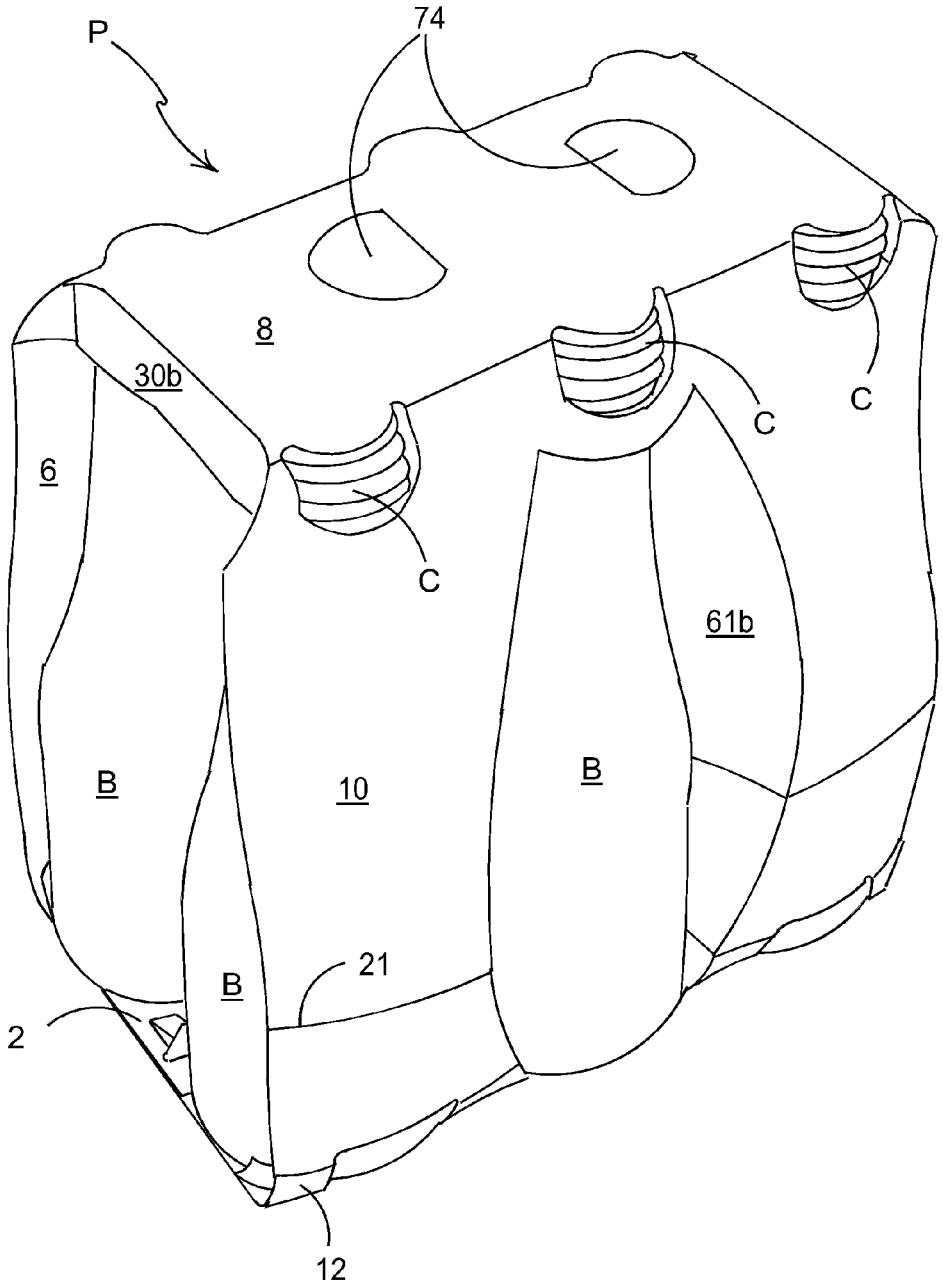
FIG. 5 is a perspective view of a package loaded with articles utilising the blank of FIG. 1.

The blank 11 is foldable to form a package P as illustrated in FIG. 5. The first and second bottom panels 2, 14 are engageable with one another in at least partially overlapping relationship to form a composite bottom wall 2, 14 of the carton. Preferably, the bottom panels 2, 14 comprise a lock system formed of complementary tabs and apertures to maintain them in engagement. To this end, a series of male tabs 55 are defined in the second bottom panel 14 and a corresponding series of female flaps 54 defined in the first bottom panel 2. When the first and second bottom panels 2, 14 are brought into superposition, the male tabs 55 are displaceable from the plane of the second bottom panel 14 and folded inwardly to extend through apertures defined by a resultant inward folding of the female flaps 54 out of the plane of the first bottom panel 2. Protrusions extending laterally of the male tabs 54 are deformed as they pass through these apertures but subsequently return to a substantially planar condition, thereby to prevent removal thereof. The first and second bottom panels 2, 14 are thus maintained in engagement.

The first bottom panel 2 further comprises portions of two first bottom locking arrangements 80 and a portion of a second bottom locking arrangement 89. Preferably, the first bottom locking arrangements 80 are disposed one either side of the second bottom locking arrangement 89.

The first bottom locking arrangements 80 extend from the first bottom panel 2 across the first bevel panel 4 and into the first side panel 6, in-so-doing interrupting the fold lines 16, 18 which hinge the first bottom panel 2, first bevel panel 4 and first side panel 6 one to the next. Each first bottom locking arrangement 80 comprises a first aperture 56 defined in the first bottom panel 2 and a second aperture 86 defined in the first side panel 6. An arrangement of panels comprising a pair of gusset panels 82*a*, 82*b* and a pair of stopper panels 84*a*, 84*b* extend between the first and second apertures 56, 86. The pair of gusset panels 82*a*, 82*b* each comprise a first gusset panel 82*a* and a second gusset panel 82*b* that are separated from one another by a cut line 81. The pair of stopper panels 84*a*, 84*b* comprises a first stopper panel 84*a* and a second stopper panel 84*b* that are separated from one another by the cut line 81. A first edge of each of the gusset panels 82*a*, 82*b* is defined by the first aperture 56 and is disposed adjacent thereto whilst an opposing second edge, which is angled with respect to the first edge, is hinged to a respective one of the stopper panels 84*a*, 84*b* by a fold line. Each of the gusset panels 82*a*, 82*b* are hinged to the first bottom panel 2 via a fold line. An edge of each stopper panel 84*a*, 84*b*, disposed opposite the respective gusset panel 82*a*, 82*b*, is defined by and is adjacent to the second aperture 86. Each of the stopper panels 84*a*, 84*b* are hinged to the first bevel panel 4 by a respective fold line. The first aperture 56 comprises an edge which is substantially equal in dimension to the combined width of the first and second gusset panels 82*a*, 82*b*. First aperture 56 comprises a V shaped recess that extends away from the gusset panels 82*a*, 82*b* into the first or second bottom panel 2, 14. This V shaped recess may be engaged by a finger or other machine tool during construction of the carton. The second aperture 86 comprise a substantially rounded edge, disposed proximate edges of the stopper panels 84*a*, 84*b* and consequently said edges are curved inwardly of the respective stopper panel 84*a*, 84*b*.

Figure 3:
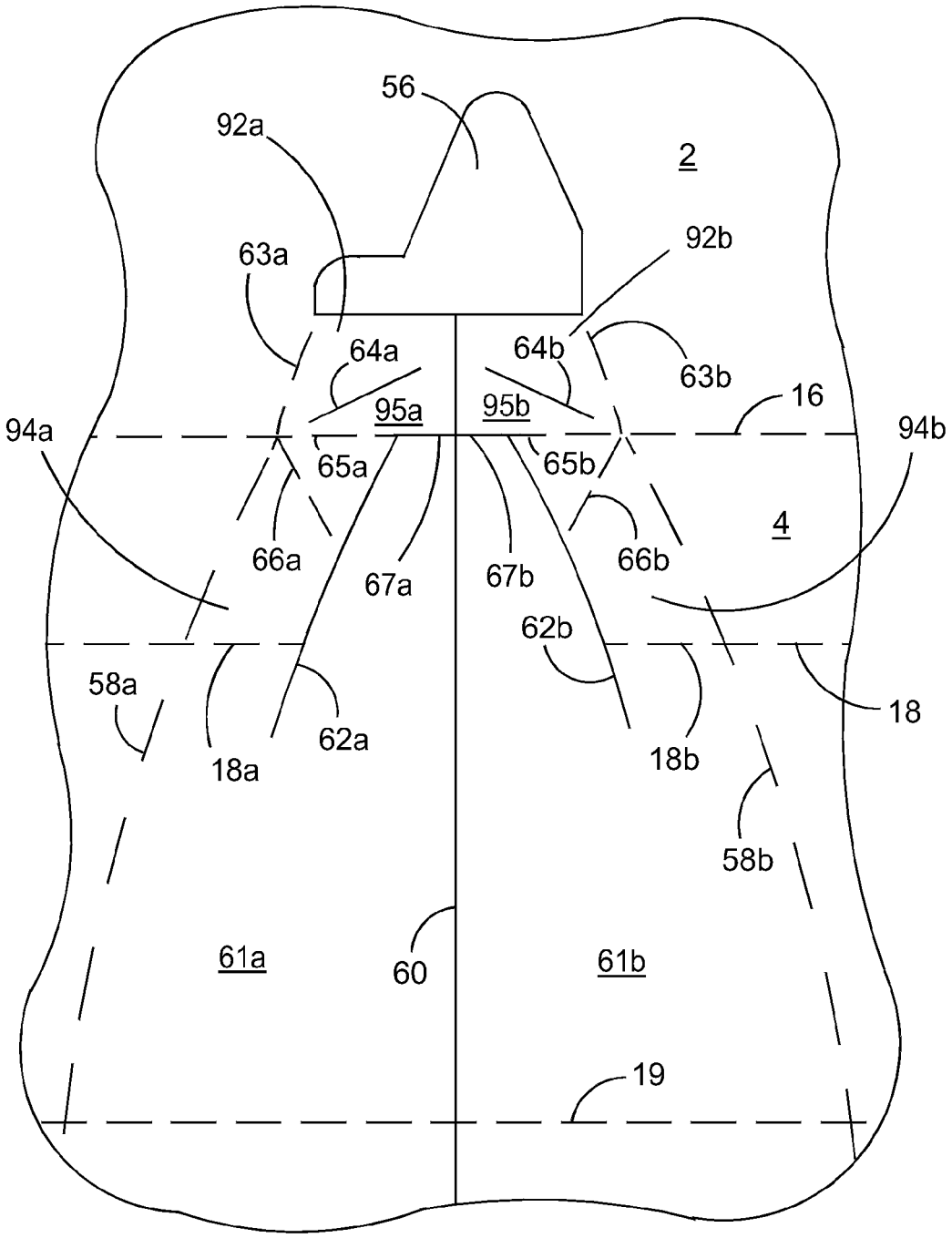
FIG. 3 is a plan view of a portion of the blank of FIG. 1.
Figure 4:
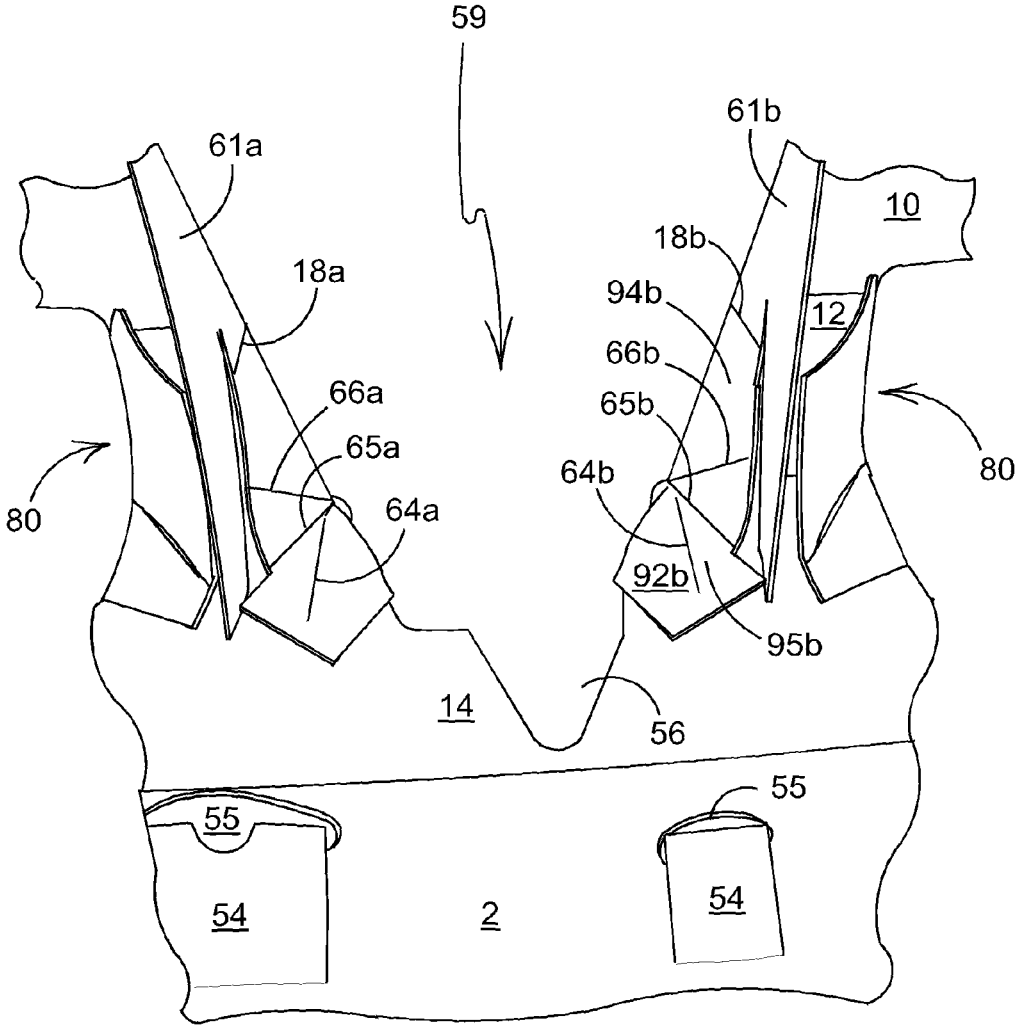
FIG. 4 is an enlarged perspective view of an article engaging arrangement of the assembled carton of FIG. 3.

The second bottom locking portion 89, best shown in the enlarged view of FIGS. 3 and 4 comprises a first aperture 56 defined in the first bottom panel 2. Bordering and extending from a proximate edge of the first aperture 56 is a pair of gusset panels 92*a*, 92*b*. This pair of gusset panels 92*a*, 92*b* comprises a first gusset panel 92*a* and a second gusset panel 92*b* that are separated from one another by a cutline 60. The gusset panels 92*a*, 92*b* are hinged along an edge disposed opposite the cutline 60, to the first bottom panel 2 by respective fold lines 63*a*, 63*b*. These fold lines 63*a*, 63*b* extend from a respective point disposed on an edge of the first aperture 56 to a respective point disposed on the fold line 16 which hinges the first bottom panel 6 to the first bevel panel 4. Opposite the edges of the gusset panels 92*a*, 92*b* that border the first aperture 56 are respective angled fold lines 64*a*, 64*b*. These angled fold lines 64*a*, 64*b* hinge the first 92*a* and second 92*b* gusset panels to a respective one of a third and fourth gusset panel 95*a*, 95*b*. Third and second gusset panels 95*a*, 95*b* extend from these angled fold lines 64*a*, 64*b* to the proximate edge of the first bottom panel 2 and terminate in a respective fold line 65*a*, 65*b* that interrupts, and is substantially co-axial with, the fold line 16 hinging the first bottom panel 2 to the first bevel panel 4. Optionally, as shown, the fold line 65 may be frangible or a cut line.

First and second stopper panels 94*a*, 94*b* are defined within window panels 61*a*, 61*b* respectively and are hinged to respective ones of third and fourth gusset panels 95*a*, 95*b* along fold lines 65*a*, 65*b*.

Extending from each of the fold lines 65*a*, 65*b* that terminate the third and fourth gusset panels 95*a*, 94*b* is a respective window panel 61*a*, 61*b*; a first window panel 61*a* is coupled to third gusset panel 95*a* and a second window panel 61*b* is coupled to fourth gusset panel 95*b*. This pair of window panels 61*a*, 61*b* extend across the bevel panel 4 and first side panel 6 from the fold line 16 hinging the bevel panel 4 to a base panel to the fold line 20 hinging the first side panel 6 to the top panel 8; so as to extend between the bottom panel 2 and the top panel 8. The window panels 61*a*, 61*b* interrupt the fold line 18 hinging the first side panel 6 to the first bevel panel 4.

It will be appreciated that in other embodiments the bevel panels 4, 12 are optional, and that the first and second side panels 6, 10 may extend to fold lines 16, 24 respectively.

The cut line 60 extends from the first bottom panel 2 across the first bevel panel 4 and across the first side panel 6 to terminate at an article retention strap 72. In the embodiment illustrated in FIG. 1 the article retention strap 72 engages a portion of an article B with the carton, best illustrated in FIGS. 2 and 3.

A slit 62*a*, 62*b* is formed respectively in each of the first and second window panels 61*a*, 61*b*, which slits 62*a*, 62*b* extend, from fold line 16, across bevel panel 4, and into side panel 6 where they terminate. The slits 62*a*, 62*b* partially separate the first and second window panels 61*a*, 61*b*. The slits 61*a*, 61*b* are arcuate in shape. The region of the window panels 61*a*, 61*b* between the slits 62*a*, 62*b* and a distal free edge of the window panel 61*a*, 61*b* forms a yieldable tab. The region of the window panels between the slits 62*a*, 62*b* and the hinged connection 58*a*, 58*b* to the bevel panel 4 comprises a fold line 66*a*, 66*b* respectively. Each fold line 66*a*, 66*b* is disposed at an angular relationship to the fold line 16 and extends substantially between the fold line 16 and the respective slit 62*a*, 62*b*, preferably, from the junction between fold line 16 and fold line 58*a*, 58*b*.

Optionally, the top panel 8 comprises two optional finger apertures 74 that may be utilised by a user to carry the carton.

Hinged to each end of the top panel 8 are top end closure arrangements 31*a*, 31*b*. These end closure arrangements 31*a*, 31*b* are preferably identical to one another and will be described by reference to top end closure arrangement 31*a*. Top end closure arrangement 31*a* comprises an end flap 30*a*, hinged to the top panel 8 along a fold line 28*a*. Perpendicular to that fold line 28*a*, along a first side of the end flap 30*a*, a first gusset flap 34*a* is hinged by fold line 44*a*. The first gusset panel 34*a* is also hinged to the first side panel 6, by fold line 42. Along a second side of the end flaps 30*a*, opposite the first, a second gusset flap 36*a*, is hinged via fold line 45*a*. The second gusset panel is hinged the second side panel 10, by fold line 46*a*.

The blank 11 further comprises a plurality of crown apertures 70 which are V-shaped and which in a set up condition receive an upper portion of an article B.

Each crown aperture 70 is struck in part from a respective side panel 6, 10 and in part from top panel 8, so as to define an arcuate shaped tab which extends over an uppermost portion of a respective article which it receives.

Turning to the construction of the carton as illustrated in FIGS. 2, 3, 4 and 5 it is envisaged that the carton can be formed by a series of sequential folding operations in a straight line machine so that the carton is not required to be rotated or inverted to complete its construction. The folding process is not limited to that described below and may be altered according to particular manufacturing requirements.

A group of articles B is assembled; in the preferred embodiment 6 articles are arranged in a 2×3 array. The top panel of the blank 11 is disposed over the group of articles B to provide a top wall 8 of the carton. Preferably, the following operations of folding to construct the first 80 and second 89 bottom locking arrangements are performed prior to folding the first and second side panels 6, 10 down around the group of articles B to provide side walls 6, 10 of the carton.

The folding of the first 80 and second 89 bottom locking arrangements and of the window panels 61*a*, 61*b* will now be described. FIG. 4 illustrates the result of these folding operations along one side of the carton, wherein the opposing side and top of the carton are omitted for clarity.

The gusset panels 82*a*, 82*b* of the first 80 bottom locking arrangements are folded into substantially flat face contacting relation with the respective one of first or second bottom panel 2, 14. This causes the stopper panels 84*a*, 84*b*, of the first bottom locking arrangements 80 to be folded relative to the respective one of the first and second bevel panels 4, 12, thereby to extend away therefrom at an angle thereto. This angle is created by the angle between the fold line hinging to the bottom panel 2, 14 the gusset panel 82*a*, 82*b* and fold line hinging the stopper panel 84*a*, 84*b* to the bevel panel 2, 12. This folding operation causes apertures to be formed where the gusset panels 82*a*, 82*b* have been displaced from panel of material of the first and second bottom panels 2, 14, first and second bevel panels 4, 12 and first and second side panels 6, 10. The stopper panels 82*a*, 82*b* curve away from the respective adjacent one of the first and second side panels 6, 10 either side of these apertures, to provide a curved receiving area into which a lower portion of an article B may be received.

The gusset panels 92*a*, 92*b*, of the second bottom locking arrangements 89 are folded into substantially flat face contacting relationship with the respective one of first or second bottom panels 2, 14. Stopper panels 94*a*, 94*b* are folded upwardly to extend substantially perpendicularly away from the respective one of the first and second bottom panel 2, 14 at an angle to the adjacent first or second bottom panel 12, 14, by virtue of the angle between the fold line hinging the gusset panel 92*a*, 92*b* to the bottom panel 2, 14 and the fold line hinging the stopper panels 94*a*, 94*b* to the first or second panel 4, 12. In the same manner as described above in relation to the first bottom locking arrangements 80, the stopper panels 94*a* 94*b* of the second bottom locking arrangements 89 are struck from the carton to leave an aperture for receiving a lower portion of an article B. In particular, it is contemplated that one or more lower portions, optionally having a petaloid shape, of article B are receivable in the resulting aperture between the stopper panels 94*a*, 94*b*.

The window panels 61*a*, 61*b* are folded inwardly of the carton as shown in FIGS. 2 to 5 such that they are interposed between a pair of adjacent articles B. Folding the window panels 61*a*, 61*b* in this manner warps the corresponding one of the first or second side panels 6, 10 to which they are attached due to the curved nature of the fold lines 58*a*, 58*b* connecting those window panels 61*a*, 61*b* to the first or second side panels 6, 10. The warping of the first and second side panels 6, 10 urges the window panels 61*a*, 61*b* against the article B, causing deformation of portions thereof that are separated from direct connection to the first or second side panels 6, 10 by a respective one of the slits 62*a*, 62*b*. So-deformed, the window panels 61*a*, 61*b* each consist of an inboard edge defined by the respective slit 62*a*, 62*b* intermediate an outboard edge defined by the cut line 60 and the corresponding one of the first 6 and second 10 side walls. This edge is disposable in a recess in a lower portion of an article received in the second bottom locking arrangement 90, as best shown in FIG. 4.

The first and second side panels 6, 10 are folded down about their respective fold lines 20, 22 into abutment with side portions of adjacent ones of those articles B to form respectively, first and second side walls 6, 10 of the carton. This brings the first bottom locking arrangements 80 of each side wall 6, 10 around proximate lower portions of the articles B and brings the window panels 61*a*, 61*b* into interposition between a central article B on an adjacent side of the group, and its neighbouring articles A on that side. The intermediate edge of the window panels 61*a*, 61*b* provided by the slit 62*a*, 62*b* is inserted into a recess in the lower portion of the article and the contoured edge of each window panel 61*a*, 61*b* abuts an upper portion of that article A.

Article retention strap 72 engages an article B in the aperture created by displacement of the window panels 61*a*, 61*b*. The article retention strap 72 engages an upper portion of the article B beneath a flange or protrusion provided by an article closure means C such as a crown cork. In the case of articles B (such as those illustrated in FIG. 7) having petaloid lower portions, it is contemplated that a petaloid portion of such an article B be receivable so as to extend through the apertures between the two adjacent stopper panels 84*a*, 84*b* of each first bottom locking arrangement 80. The projecting portion of the first aperture 56 provides a shaped edge that optionally abuts an interior side of that petaloid portion. Preferably, the dimension of the aperture measured between the stopper panels 84*a*, 84*b*, is selected to prevent the article B from egressing the carton. Lateral movement of the article B in the longitudinal axis of the carton is prevented by the presence of the stopper panels 84*a*, 84*b* disposed partially around opposing sides thereof. In the loaded carton, it is contemplated that movement directly away from the stopper panels 84*a*, 84*b* is precluded by the presence of an adjacent row of articles similarly engaged by an opposing first bottom locking arrangement 80 in the opposing side wall 6, 10. The intermediate edges of the window panels 61*a*, 61*b* are inserted into recesses formed between neighbouring petaloid portions of the articles B, such that one or more on those petaloid portions extend through the aperture formed between the stopper panels 94*a*, 94*b* of the second bottom locking arrangement 90. Again this aperture is dimensioned to prevent egress of the articles B therethrough.

Figure 2:
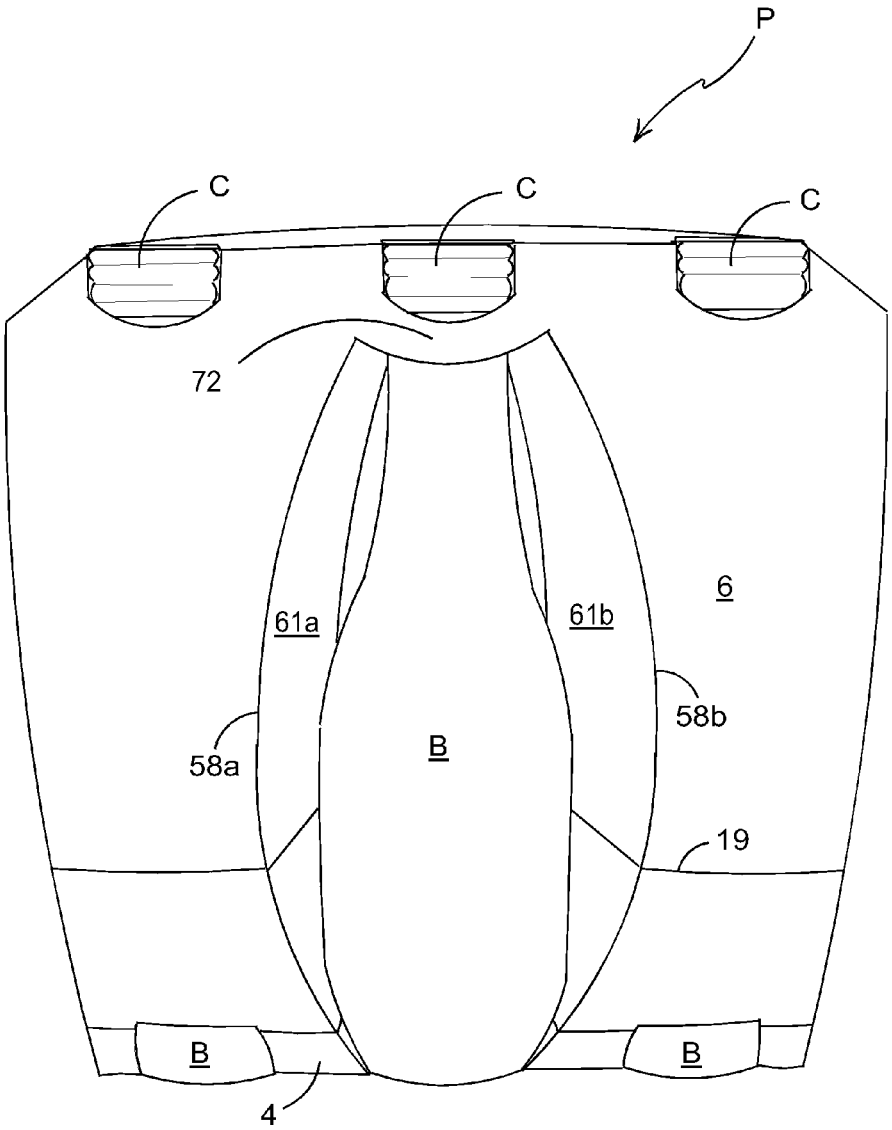
FIG. 2 is a side view of an erected carton formed from the blank of FIG. 1.
Figure 7:
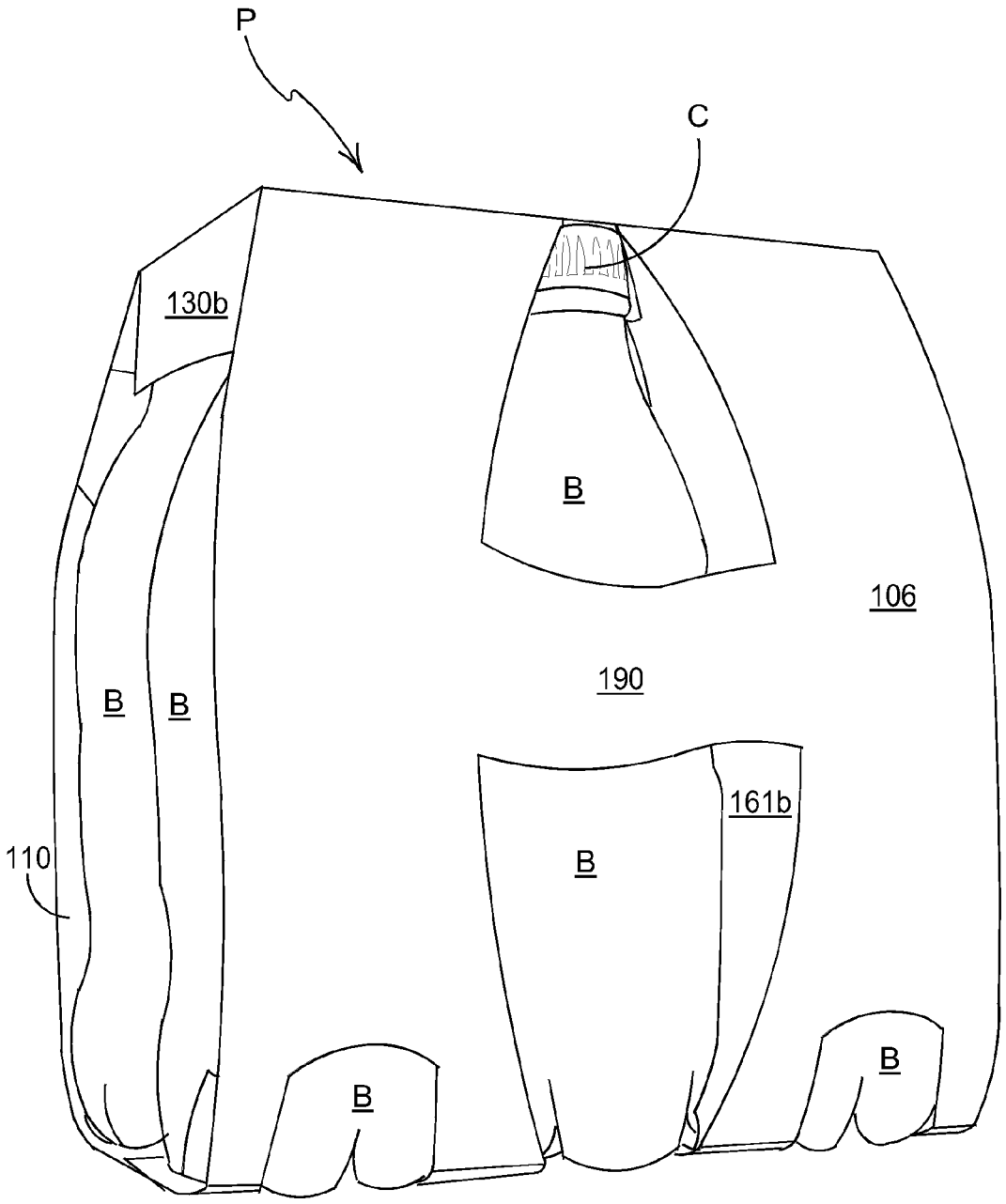
FIG. 7 illustrates a carton formed from the blank of FIG. 6.

It will be appreciated that when the carton is utilised with articles B having a different lower cross section shape to those in FIG. 7, such as a round cross section as illustrated in FIGS. 2 and 5 the bottom locking arrangements 80, 90 engage lower portions of the articles, in particular the stopper panels 84*a*, 84*b*, 94*a*, 94*b* engage about opposing side of the article B to retain the lower portion in position.

The first and bottom panels 2, 14 are secured in overlapping relationship to provide a bottom wall of the carton by folding the tabs 55 of the first bottom panels 2 into the carton, thereby striking the flaps 54 of the second bottom panel 14. The tabs 55, so inserted, maintain the first and second bottom panels 2, 14 in overlapping relationship. The erected carton is best shown in FIG. 5.

The ends of the carton are at least partially closable, as best shown in FIG. 5, to prevent the articles from being removable therethrough, by folding the gusset panels 34*a*, 36*a* of the end closure arrangements into flat face contacting relation with proximate one of the first or second side panels 6, 10. This as a result causes the end flap 30*a*, 30*b* to be pulled down to at least partially close the end of the carton.

The first and second bottom panels 6, 14 are then folded around underneath the group of articles B such that they may be secured one to the other through use of the complementary punch lock formed by the tabs 55 and flaps 54 to form a composite bottom wall 55/54 of the carton.

Crown apertures 70 receive an upper portion of the article as shown in FIG. 5.

Article retention strap 72 prevents the article displayed in the viewing window arrangement 59 from being removed, or unintentionally egressing from the carton. This is particularly useful when the article B is shaped with a tapered neck.

Figure 6:
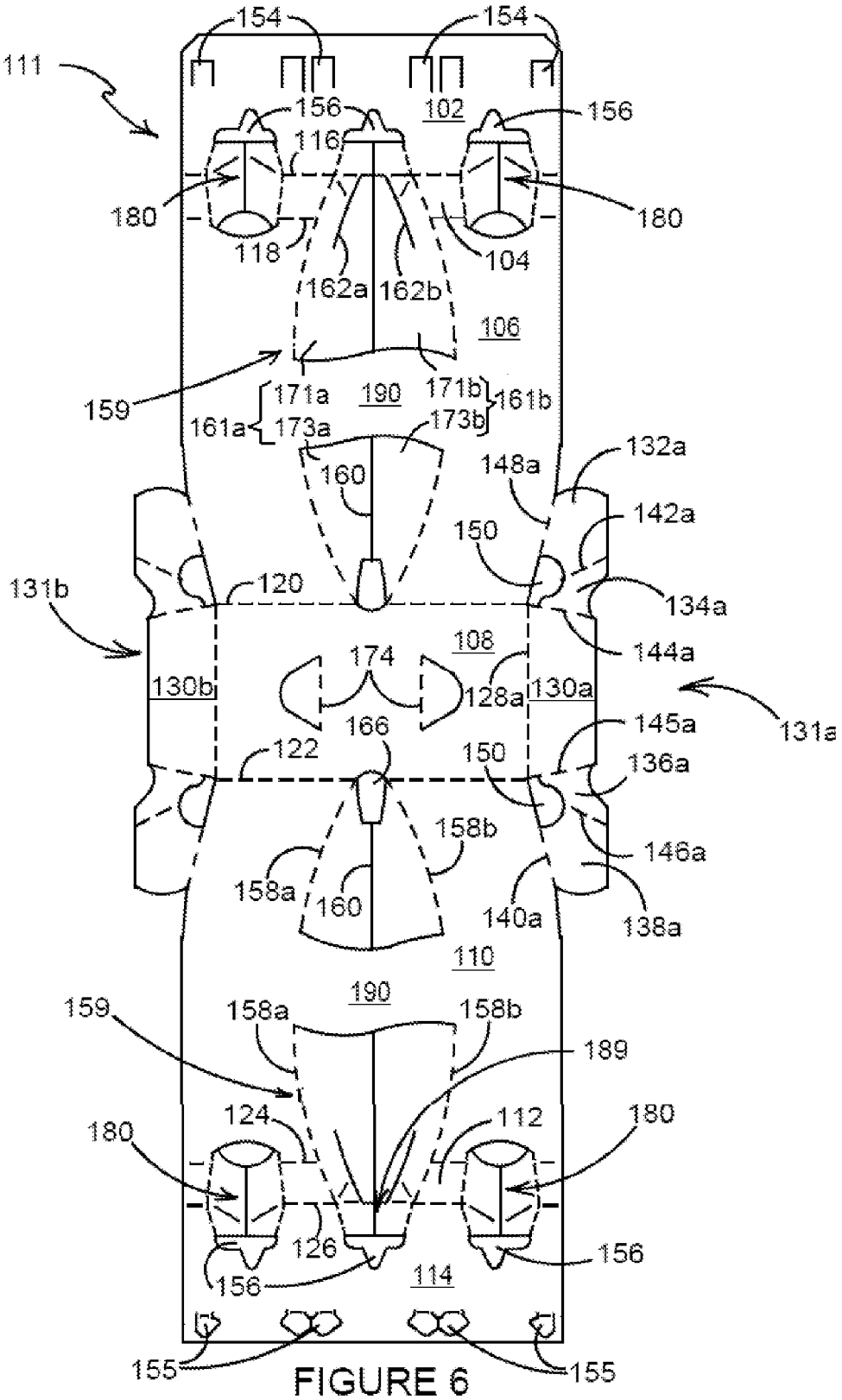
FIG. 6 illustrates a blank for forming a carton according to a second embodiment of the present invention; and illustrates a carton formed from the blank of FIG. 7.

Referring now to FIGS. 6 and 7, there is shown an alternative embodiment of the present invention. In the second illustrated embodiment, like numerals have, where possible, been used to denote like parts, albeit with the addition of the prefix "100" to indicate that these features belong to the second embodiment. The alternative embodiments share many common features with the first embodiment and therefore only the differences from the embodiments illustrated in FIGS. 1 to 5 will be described in any greater detail.

FIG. 6 illustrates a blank 111 according to a second embodiment, wherein blank 111 comprises a linear series of panels consisting of a first bottom panel 102, first lower bevel panel 104, first side panel 106, top panel 108, second side panel 110, second lower bevel panel 112 and second bottom panel 114 hinged one to the next by respective fold lines 116, 118, 120, 122, 124, 126.

Each of the first and second bottom panels 102, 114 comprise two first bottom locking arrangements 180 disposed one either side of a second bottom locking arrangement 189. Each of these first and second bottom locking arrangements 180, 189, substantially corresponds to those of the first preferred embodiment described above. It will be noted that in the second embodiment the fold line 64*a*, 64*b* has been omitted.

The viewing window arrangement 159 comprises an article retention strap 190 which substantially interrupts the window panels 161*a*, 161*b* into two pairs of hingable tabs 171*a*, 171*b*, 173*a*, 173*b*.

Hinged to each end of the top panel 108 are end closure arrangements 131*a*, 131*b*. These end closure arrangements 131*a*, 131*b* are preferably identical to one another and will be described by reference to end closure arrangement 131*a*. End closure arrangement 131*a* comprises and end flap 130*a*, hinged to the top panel 108 along a fold line 128*a*. Perpendicular to that fold line 128*a*, along a first side of the end flaps 130*a*, are sequentially hinged a first gusset flap 134*a* and a first anchor flap 132*a* via respective fold lines 144*a*, 142*a*. The anchor flaps 132*a* is also hinged along an opposing side to the first side panel 106, by fold lines 148*a*. Along a second side of the end flaps 130*a*, opposite the first, are sequentially hinged a second gusset flap 36*a*, and a second anchor flap 38*a* via respective fold lines 145*a*, 146*a*. The anchor flap 138*a* is also hinged to the second side panel 10, by fold lines 148*a*. Aperture 50 is formed intermediate proximate side edges of the first side panel 106 or second side panel 110 and the corresponding ones of the gusset panels 134*a*, 136*a* and anchor panels 132*a*, 138*a*.

At an end of the window panels 161*a*, 161*b* adjacent a top panel 108 of the blank 111 there is formed a cut out 166 in the adjacent edges thereof. This cut out 166 is defined, on each side, by an edge extending inwardly of each window panel 261*a*, 261*b* from a cut line 160 separating the two window panels 261*a*, 261*b*. From a terminal point on this edge the window panels 161*a*, 161*b* taper away from one another to intersect with terminal points of a small concave cut out in a proximate edge of the top panel 108. The cut out 166 defines in part an engaging edge of the window panels 161*a*, 161*b* which in use may engage below a crown cork or other protrusion or flange extending from an article received in the viewing window arrangement 159.

A carton may be set up from the blank 111 through a series of folding operations in substantially the same manner as described above except where specifically provided for below.

Each of window panels 161*a*, 161*b* is folded internally of the carton. The lower window panels those located below the article retention strap 190 in use are folded substantially in the manner described above in relation to the first embodiment. It is necessary to fold the upper window panels 161*a*, 161*b* out of the plane of the first and second side panels 106, 110, prior to folding the side walls 106, 110 about a group of articles B.

The ends of the carton are at least partially closable, to prevent the articles B from being removable therethrough, by folding the gusset panels 132, 138 of the end closure arrangements into flat face contacting relation with proximate one of the first or second side panels 106, 110. This as a result causes the anchor panels 134, 136 to pull the end flap 130*a*, 130*b* down into coplanar relation with the edges of the side walls 106, 110.

The first and second bottom panels 102, 114 are then folded around underneath the group of articles B such that they may be secured one to the other through use of the complementary punch lock formed by the tabs 155 and flaps 154 to form a bottom wall 102,114 of the carton.

It can be appreciated that various changes may be made within the scope of the present invention, for example, the size and shape of the panels and apertures may be adjusted to accommodate articles of differing size or shape. In other embodiments of the invention it is envisaged that the cut line between the stopper panels and the window panels of the second bottom locking arrangement in fact be a fold line. Also the shape of the fold line connecting the window panels to the side walls may be altered, for example to match the outline of the article to be held in the carton. Similarly, the apertures of the carton (of either embodiment) may be free altered in size and shape to accommodate differing article geometries. The number of articles and their arrangement may be altered.

It is also contemplated that the embodiments described above do not form isolated configurations and that features from one of the embodiments may be freely combined with those of the other of the embodiment as desired. For example the crown apertures 70 may be employed in the second embodiment for one or more articles, for example the outermost articles only or all the articles.

It can be seen from FIG. 7 that the article retention strap 190 substantially bisects the viewing window arrangement 159.

Alternatively, it can be said that the viewing window arrangement 159 comprises four window panels, a first pair located below the article retention strap and a second pair located above the article retention strap 190.

In the illustrated embodiment the article retention strap 190 comprises arcuate edges, which are substantially wave like in shape, in other embodiments the straps are envisaged in particular but not limited to linear edges, for example a horizontal board having linear edges.

In alternative embodiments other panel interlocking means are envisaged including but not limited to adhesive.

In another alternative embodiment, the portion of the article (in the display window) obscured by the retention strap 190 is less in surface area than the portion or portions displayed in the display window.

It will be noted that the top panel 18, 108 is shorter in longitudinal dimension than the bottom panels. This is to provide close proximity of the end closure structure to the upper portion of the articles B, which articles are tapered and have a smaller dimension towards the top than at the base.

In other embodiments when different article shapes are being packaged, including but not limited to substantially parallel sided articles of flanges articles, the top panel may comprise a longitudinal dimension equal or greater that the base.

It will be recognized that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection or a fold line should not be construed as necessarily referring to a single fold line only; indeed it is envisaged that hinged connection can be formed from one or more of the following, a short slit, a frangible line or a fold line without departing from the scope of the invention.

The invention claimed is:

1. A package comprising a carton and two or more articles received in the carton, the carton comprising a top panel, first and second side panels and a bottom panel, the top panel being disposed on top of the two or more articles, the bottom panel being disposed under the two or more articles, the two or more articles including at least one window article, the carton comprising at least one display window in which the at least one window article is displayed, the at least one display window being struck at least in part from at least one of the side panels, the at least one display window is interrupted by a retention strap that engages the at least one window article, the at least one display window being divided by the retention strap into top and bottom portions such that one of the top and bottom portions extends from the retention strap to reach an adjacent one of the top and bottom panels and receives an adjacent one of upper and lower portions of the at least one window article, wherein the other of the top and bottom portions of the at least one display window is defined at least in part by two window tabs hinged to the at least one of the side panels by two weakened lines respectively, the two weakened lines being disposed spaced apart from each other to define therebetween the other of the top and bottom portions of the at least one display window, the two window tabs being folded inwardly about the two weakened lines into the carton such that the two window tabs provide a frame around at least a portion of the at least one window article, the frame being visible through the at least one display window when the at least one window article is displayed in the at least one display window, at least one of the two window tabs being interposed between the at least one window article and an adjacent one of the two or more articles such that at least a portion of the adjacent one of the two or more articles is hidden from view by the at least one of the two window tabs when the at least one window article is viewed through the at least one display window, wherein the retention strap engages at least an upper portion of the window article beneath a flange or protrusion provided by a closure element of the window article.

2. The package according to claim 1, wherein each of the two window tabs extends to an end edge thereof from a respective one of the two weakened lines, and wherein each of the two window tabs has a cut out formed along the end edge thereof.

3. The package according to claim 2 wherein the cut out defines in part an engaging edge of the respective one of the two window tabs, the engaging edge being disposed to engage the at least one window article.

4. The package according to claim 1 wherein the other of the top and bottom portions is further defined by a curved edge of the retention strap, the curved edge extending between the two weakened lines.

5. The package according to claim 4 wherein the curved edge of the retention strap defines a curved edge of each of the two window tabs, wherein each of the two window tabs has an end edge which intersects the curved edge of a respective one of the two window tabs, and wherein each of the two window tabs has a cut out formed along the end edge thereof.

6. The package according to claim 5 wherein the cut out is spaced apart from the curved edge of the respective one of the two window tabs.

7. The package according to claim 6 wherein the cut out is located at an end of the end edge of the respective one of the two window tabs, the end of the end edge being disposed opposite the curved edge of the respective one of the two window tabs.

8. A blank for forming a carton, the blank comprising a top panel, a bottom panel, a side panel connecting between the top and bottom panels, and a display window struck at least in part from the side panel, the display window being interrupted by a retention strap such that the display window is divided into top and bottom portions wherein one of the top and bottom portions extends from the retention strap to reach an adjacent one of the top and bottom panels, wherein the other of the top and bottom portions is defined at least in part by two window tabs which are connected to the side panel by two weakened lines respectively, the two weakened lines being disposed spaced apart from each other to define therebetween the other of the top and bottom portions, the two window tabs being foldable about the two weakened lines into the carton such that the two window tabs, when the carton is erected, provide a frame around at least a portion of a window article that is to be received in the carton, the frame being visible through the display window when a window article is displayed in the display window, wherein the two window tabs are separated from each other by a severance line, and wherein each of the two window tabs has a cut out formed along the severance line and wherein the cut out is spaced apart from the retention strap, wherein the blank is configured such that, when the carton is erected, the retention strap engages at least an upper portion of the window article beneath a flange or protrusion provided by a closure element of the window article.

9. The blank according to claim 8 wherein the cut out is located at an end of the severance line opposite the retention strap.

10. A carton comprising a top panel, first and second side panels, a bottom panel, and at least one display window for displaying at least one article to be contained in the carton, the at least one display window being struck at least in part from at least one of the side panels, the at least one display window is interrupted by a retention strap for engaging at least one article to be contained in the carton, the at least one display window being divided by the retention strap into top and bottom portions such that one of the top and bottom portions extends from the retention strap to reach an adjacent one of the top and bottom panels, wherein the other of the top and bottom portions of the at least one display window is defined at least in part by two window tabs hinged to the at least one of the side panels by two weakened lines respectively, the two weakened lines being disposed spaced apart from each other to define therebetween the other of the top and bottom portions of the at least one display window, the two window tabs being folded inwardly about the two weakened lines into the carton such that the two window tabs provide a frame around at least a portion of at least one article in the at least one display window, the frame being visible through the at least one display window when the at least one window article is in the at least one display window, wherein each of the two window tabs extends to an end edge thereof from a respective one of the two weakened lines, and wherein each of the two window tabs has a cut out formed along the end edge thereof and wherein the cut out is spaced apart from the retention strap, wherein the retention strap engages at least an upper portion of the window article beneath a flange or protrusion provided by a closure element of the window article.

11. The carton according to claim 10 wherein the other of the top and bottom portions is further defined by a curved edge of the retention strap, the curved edge extending between the two weakened lines.

12. The carton according to claim 11 wherein the curved edge of the retention strap defines a curved edge of each of the two window tabs, and wherein the end edge of each of the two window tabs intersects the curved edge of a respective one of the two window tabs.

13. The carton according to claim 12 wherein the cut out is spaced apart from the curved edge of the respective one of the two window tabs.

14. The carton according to claim 12 wherein the cut out is located at an end of the end edge of the respective one of the two window tabs, the end of the end edge being disposed opposite the curved edge of the respective one of the two window tabs.

15. The package according to claim 1 wherein the top portion of the at least one display window is defined by a perimeter which is free of connection to any other part of the carton.

16. The blank according to claim 8 wherein the two weakened lines are two curved weakened lines respectively.

17. The blank according to claim 8 wherein the top portion of the display window is defined by a perimeter which is free of connection to any other part of the carton.

18. The carton according to claim 10 wherein the two weakened lines are two curved weakened lines respectively.

19. The carton according to claim 10 wherein the top portion of the display window is defined by a perimeter which is free of connection to any other part of the carton.

* * * * *